United States Patent [19]

Lewis, Jr.

[11] 4,109,965

[45] Aug. 29, 1978

[54] PICKING DEVICE

[75] Inventor: John C. Lewis, Jr., Salisbury, Vt.

[73] Assignee: Tucel Industries, Inc., Middlebury, Vt.

[21] Appl. No.: 757,564

[22] Filed: Jan. 7, 1977

Related U.S. Application Data

[63] Continuation-in-part of Ser. No. 618,284, Oct. 10, 1975, Pat. No. 4,009,910.

[51] Int. Cl.[2] ..... A46D 1/08

[52] U.S. Cl. ..... 300/7; 300/8; 300/21

[58] Field of Search ..... 300/1, 5, 7, 8, 21

[56] References Cited

U.S. PATENT DOCUMENTS

| | | | |
|---|---|---|---|
| 2,664,316 | 12/1953 | Winslow, Jr. et al. | 300/21 |
| 3,471,202 | 10/1969 | Lewis | 300/21 |
| 3,596,999 | 8/1971 | Lewis | 300/21 |
| 4,009,910 | 3/1977 | Lewis | 300/21 |

*Primary Examiner*—Granville Y. Custer, Jr.
*Attorney, Agent, or Firm*—LeBlanc & Shur

[57] ABSTRACT

This invention relates to new and useful brush making apparatus which allows the manufacture of a wide variety of different type brush constructions having flared tufts. The apparatus is capable of picking, trimming and assembling all the synthetic filament tufts required in a tufted brush construction simultaneously and fusing the tufts at different angles from one another onto a separate substrate. The apparatus comprises a filament stock box for dispensing cut-to-length synthetic filament, a new and improved picking element containing movable means for changing the parallel attitude of at least two adjacent picker tubes, melting means for fusing one end of the synthetic filament, and mounting means for attaching fused filament ends onto a substrate.

7 Claims, 14 Drawing Figures

PICKING DEVICE

This application is a continuation-in-part of my co-pending patent application Ser. No. 618,284, filed Oct. 10, 1975, now U.S. Pat. No. 4,009,910, issued Mar. 1, 1977, the disclosure of which is hereby incorporated by reference.

This invention relates to new and useful brush making machinery for continuously fabricating synthetic filament constructions. The apparatus is particularly adapted to form a wide variety of filament constructions wherein the ends of the filaments are fused and supported before they cool, so that the cooled, prefused ends only connect the filament unit and the support, or hold the filament unit onto the support in non-parallel attitude whereby at least two separate tufts extend from the support at acute angles thereto.

The brush industry and the brushmaking art during the past fifty years has remained, for the most part, unchanged. Major changes have come about in raw materials employed, i.e., synthetic filaments replacing vegetable fibers, molded thermoplastic handles replacing wooden handles, and the like, but little or no change has taken place in forming tufts and/or tufting multi-tufted constructions.

With the economic changes taking place during the 1970's and the dependence on oil and oil derivatives, i.e., plastic resins used for synthetic filaments and molded brush blocks, coupled with increasing costs for energy and these raw materials, there comes a need to find new ways to construct tufted synthetic brushes and filament constructions so (1) raw material can be conserved and (2) fabrication of less raw material utilizing less energy.

Picking devices for fabricating tufted constructions from synthetic filaments are described in, i.e., my U.S. Pat. No. 3,471,202, now U.S. Pat. No. Re27,455 and my U.S. Pat. No. 3,799,616, among others. However, the improved devices of the instant invention while similar in construction have the additional capability of allowing one to pick and trim angled (flared) tufts and construction wherein filament conservation and utility are achieved.

For example, conventional tufted brushes comprise at least three raw materials: one, the handle; two, filament with a length more than twice the finished tuft length out of the handle; and three, a wire staple. Handle thicknesses of at least three-six tenths inches must be employed to accommodate drilled holes in order that the stapled tuft (held by wire staples) can be supported in the handle. The brush construction of this invention, in contrast, comprises only a handle with thickness in the range of forty thousandths inches with filament attached thereto, both constructed preferably from polypropylene.

It will be obvious to those skilled in the art that a wide variety of different filament constructions, in addition to ordinary household brushes, may be made utilizing the machinery of this invention to be hereinafter described. For example, the machinery of this invention may also be adopted to form tufted constructions wherein the prefused tuft end is mounted on a heat-softened depression on a sheet or handle of the filamentary material.

Additional tufted construction may also be formed wherein the prefused tuft end is mounted on a small diameter rod, or on woven and nonwoven mesh. The rod or mesh may be wire, cellulose or plastic material, and is embedded in the prefused tuft end before the end cools.

Finally, the tuft may be picked by or inserted into a sheet support exposing both the working and non-working ends of the tuft. The non-working end may then be heat-sealed to retain the tuft in the support.

Related articles and methods of construction are described and claimed in my U.S. Pat. Nos. 3,774,782; 3,633,974; Re27,455; 3,604,043; 3,799,616; 3,798,699; 3,910,637 and my co-pending patent application Ser. No. 618,284, filed Oct. 10, 1975. The disclosures of the aforesaid related patents and patent application are hereby incorporated by reference.

Accordingly, it is therefore an object of this invention to provide new and useful brush making machinery adaptable for use in forming multiple fiber tufts, complete brush or tufted components simultaneously formed, and continuous modular brush or tufted constructions.

It is another object of this invention to provide a machine which will simultaneously pick fiber tufts, assemble the tufts in a predetermined pattern, imparting a flare and form an integral fiber tuft support modular tufted construction.

It is another object of this invention to provide a brush machine wherein the picking unit comprises movable picking tube supports including means for changing the attitude of the picking supports during tufting.

It is a further object of this invention to provide a machine for forming tufted constructions including means for heat-sealing the fiber tufts integral with a support.

It is further an object to provide a machine for making flared tufted constructions which assembly cut-to-length thermoplastic fibers into fiber tufts, each of said tufts having a prefused end for mounting and a working end which does not require trimming.

These and other objects will become more readily apparent with reference to the appended drawings and following description wherein.

Figure 1:
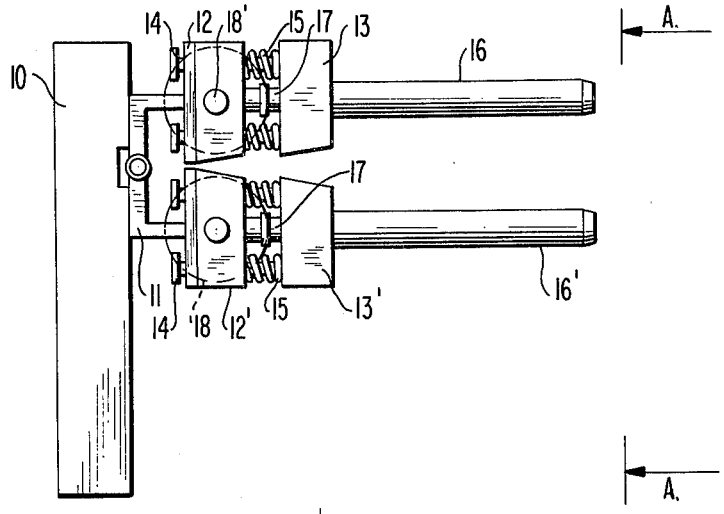
FIG. 1 is a side view of a tuft forming picker of this invention.

In order to describe this invention more fully, reference is now made to specific embodiments illustrated in the drawings. This invention is directed to houseware brush articles and the like wherein tufted synthetic filament is attached directly to a substrate at different angles employing a tuft-forming picker in such a manner that tufts are simultaneously picked in parallel attitudes, simultaneously heat-sealed for mounting, simultaneously angled and mounted onto a support thus forming a complete angle-tufted construction in the same time required by a conventional brush machine to pick and staple-set one fiber tuft. This new and novel method of picking angled filament tufts is achieved by employing a longitudinal, genrally tubular picker having a preselected cross-sectional configuration, and in a preferred embodiment, a series of picker tubes mounted to more than one movable picker tube support means. The tuft forming picker means of this invention is shown in FIG. 1.

The tuft forming picker 16 of FIG. 1 is shaped as a circular picker in cross-section. Alternative, cross-sectional shapes, i.e., oval, square, rectangular, triangle, and the like, are all possible, and are also intended to be included within the scope of this invention. This invention is not intended to be limited to preferred embodiments as shown in FIG. 1.

Figure 2:
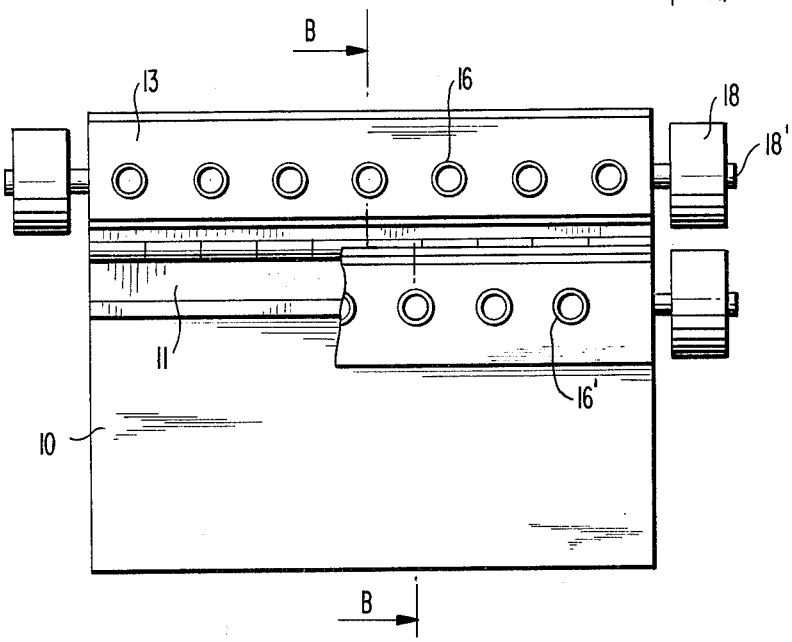
FIG. 2 is a front sectional view of a tuft forming picker taken along line A—A of FIG. 1.

The tuft forming picking means of FIG. 1 has picker tubes 16 and 16′ mounted within separate picker tube supports 13 and 13′. In each picker tube 16 and 16′, there are contained slidable trim end elements 17, which act as pistons to index cut-to-length filament, when contained in picker tubes 16 and 16′ thus trimming and allowing the extend filament end to fuse when contact is made with a melting means. Each movable picker tube support 13 and 13′ is attached to a plate 12 and 12′, respectively, by means of springs 15 and mount pins 14. In turn, each plate 12 and 12′ is attached to a hinge 11 and one portion of hinge 11 is attached permanently to picker means mount 10. Cam follower 18 is attached to plate 12 by means of pin 18′ and serves to index the lower picker plate 12 upward, thus changing the parallel relationship of pickers 16 and 16′ to an angular attitude. FIG. 2 illustrates the front view of FIG. 1 taken along line A—A of FIG. 1.

Figure 3:
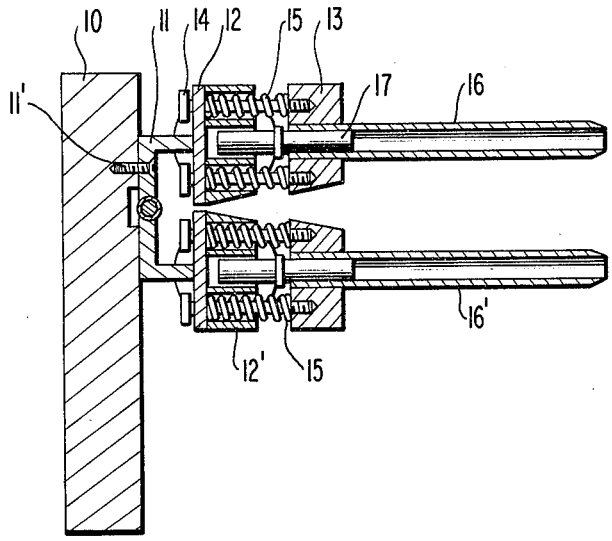
FIG. 3 is a cross-sectional view taken along line B—B of FIG. 2.

FIG. 3 is in cross-section taken along line B—B of FIG. 2. Hinge 11 is attached to mount 10 by screw attachment 11′.

Figure 4:
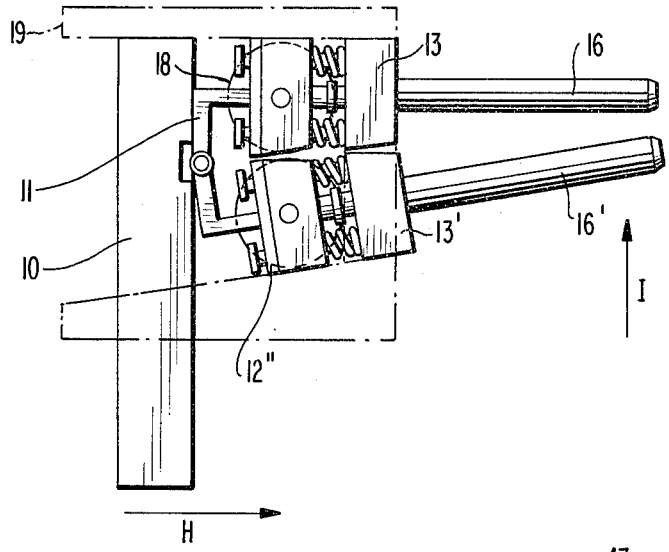
FIG. 4 is a side view of the tuft forming picker of FIG. 1 at an angled attitude prior to forming the angled tuft-construction.

FIG. 4 illustrates the closing of tube supports 13 and 13′ by indexing picker device support 10 into cam closure means 19 in the direction of H causing the end of picker tube 16′ to converge on the end of tube 16 in direction I.

Figure 5:
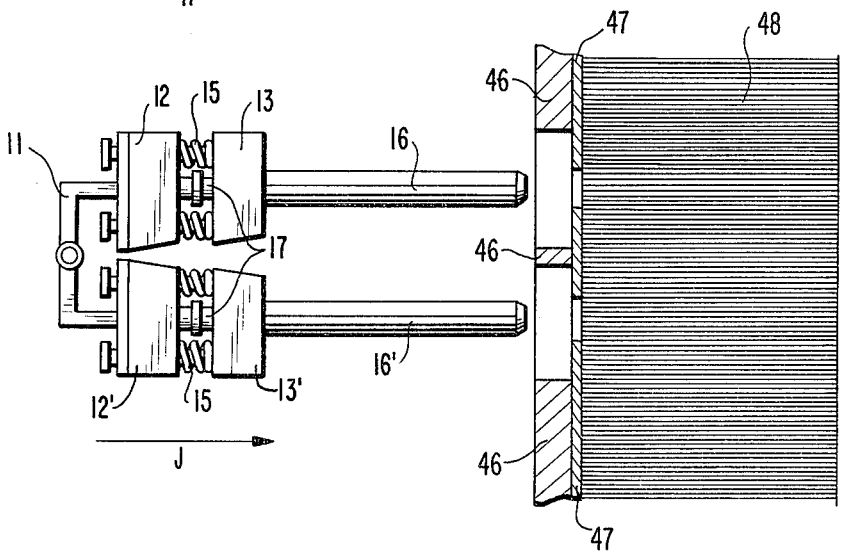
FIG. 5 is a longitudinal view of the tuft forming picker of FIG. 1 prior to indexing into a filament stock box.
Figure 6:
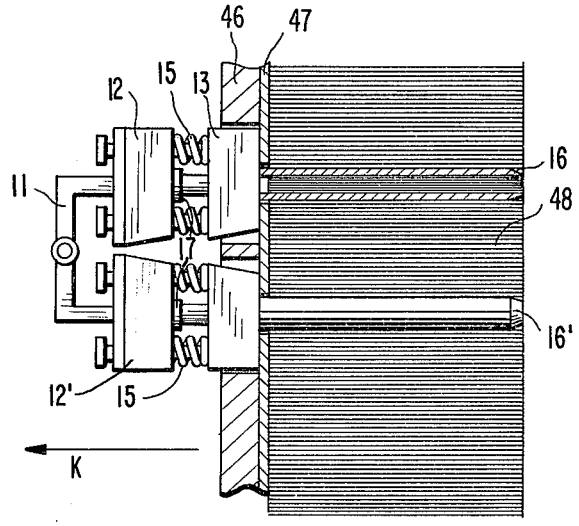
FIG. 6 is a longitudinal view of the tuft forming picker of FIG. 5 as indexed into a filament stock box.

Attention is now drawn to picking and tufting angular (flared) tufts. The picking device illustrated in FIG. 5 is indexed in direction J causing picker tubes 16 and 16′ to pass through stock box front 46 and filament retaining gasket 47 and engage filament 48. As this sequence takes place, tube supports 13 and 13′ and plates 12 and 12′ remain open by springs 15 so that sliding trim pins 17 may be displaced toward the hinge 11 and plate 12 and 12′. The parallel relationship of picker tubes 16 and 16′ is maintained during picking. In FIG. 6, the trim end element 17 is shown pushed back into plates 12 and 12′ allowing filament 48 to fill the picker tubes 16 and 16′ whereby the filament is contained entirely within the picker tube and abuts trim end element 17. After picking is complete, the filled picker device is indexed in direction K withdrawing the tubes from the stock box.

Figure 7:
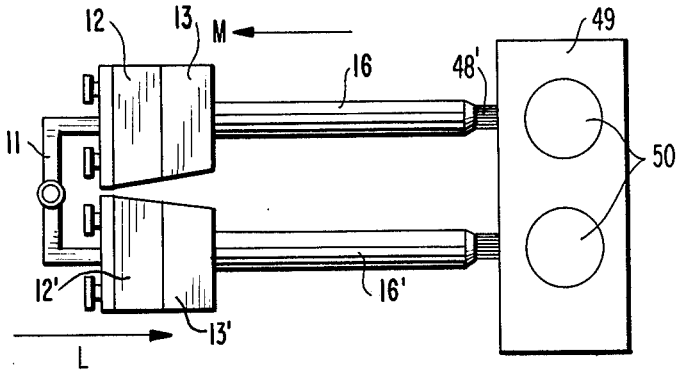
FIG. 7 is a longitudinal view of the tuft forming picker of FIG. 6 as withdrawn from a filament stock box with the picking tube support and trim ends in a closed attitude and filament ends fused against a melter block.
Figure 8:
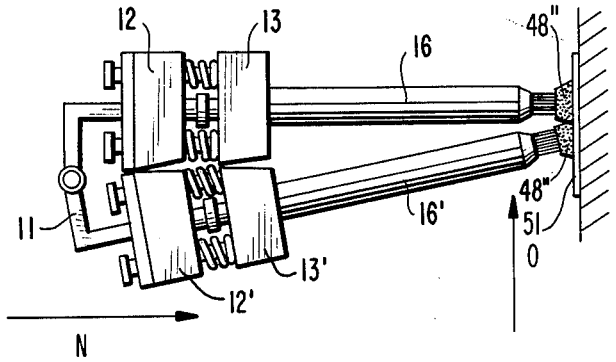
FIG. 8 is a longitudinal view of the tuft forming picker of FIG. 7 in the angled fusing attitude.

In order to allow the ends of filament 48 to become fused, the picking device of FIG. 7 is indexed in direction L and closed in direction M. The picker tube supports 13 and 13′ with picker tubes 16 and 16′, then contact plates 12 and 12′, causing filament ends 48′ to emerge from the picker tubes 16 and 16′ and contact melter block surface 49. Block 49 is heated by cartridge heaters 50. During the fusing of filament ends 48′, the parallel relationship of picker tubes 16 and 16′ is maintained. After fusing the picking device is withdrawn from the fusing block 49, and indexed in direction N. While indexing in direction N, the picker tube supports 13 and 13′ are allowed to change attitude by moving hinge 11 thus causing picker tubes 16 and 16′ to come together, and fused filament ends 48″ to meet. As the picker tubes 16 and 16′ close toward each in direction O, the fused portion is contacted with tuft support 51 causing the filament to be attached to tuft support 51 by fused portion 48″.

Figure 9:
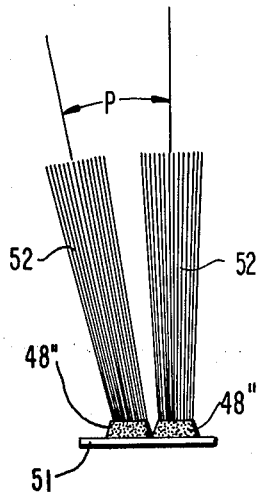
FIG. 9 is a side view of the tufted article made in accordance with this invention.

FIG. 9 illustrates the tufted support 51 with tufts 52 attached to support 51 by fused portion 48″, whereby an angle P exists between the two non-parallel tufts.

In order to show a preferred embodiment, attention is now directed to a specific tufted counter duster brush, and FIGS. 10–14 as means of illustrating and not limiting this invention.

Figure 10:
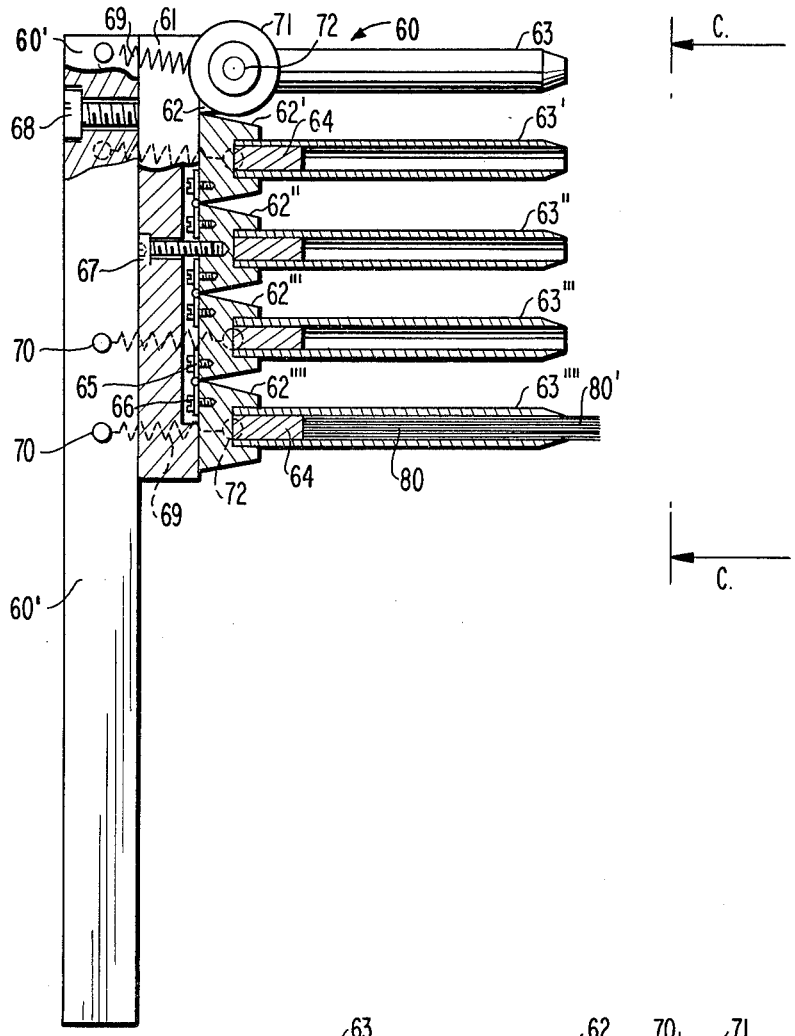
FIG. 10 is a longitudinal view in partial section of a picking means for tufting an entire brush in accordance with this invention.
Figure 11:
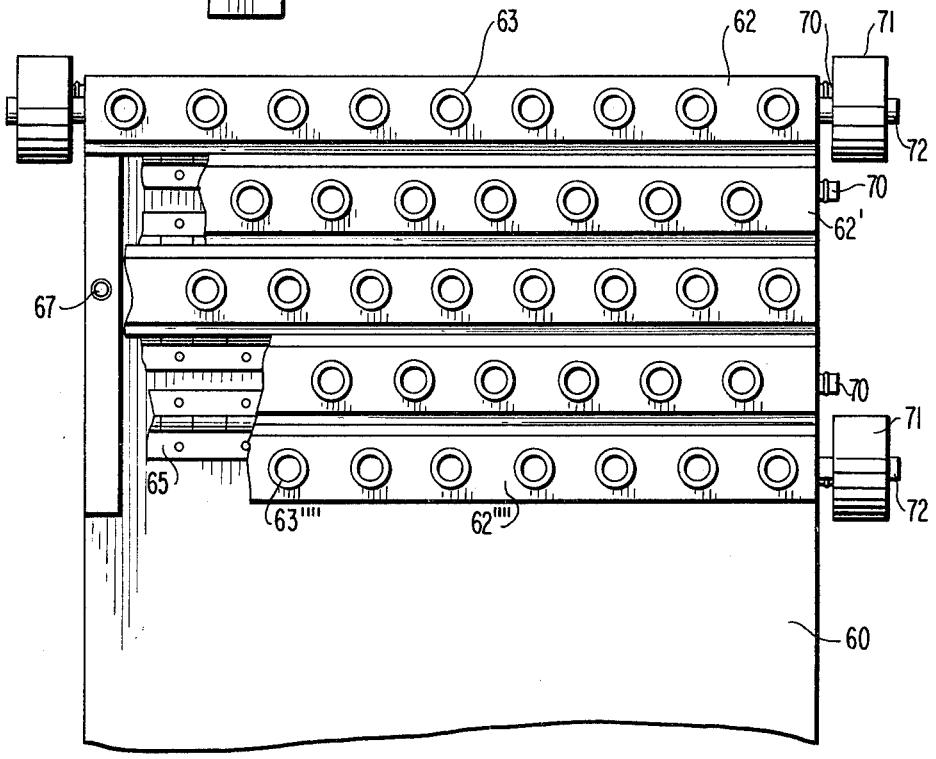
FIG. 11 is a frontal view with portions broken away of the picking means taken along line C—C of FIG. 10.

Picker device 60 of FIGS. 10 and 11 is mounted on mount 60′ having five rows of picking tubes, 63, 63′, 63″, 63‴ and 63⁗, all attached to fixed supports 62, 62′, 62″, 62‴, and 62⁗. The pickers in this embodiment each have a stationary trim end pins 64 located at the base of each tube for trimming the filament 80, and automatically allowing a given amount of filament 80′ to extend from the picker tube. Tube supports 62 are attached to each other by means of hinge 65 and screw 66. Only picker tube support 62″ is attached to stationary picker device 60′ by means of bar 61 and screw 67. Fastening screw 68 holds bar 61 to the picker support 60′. Cam followers 71 are attached to picker supports 62 and 62⁗ by pins 72, and the picking tube supports are held in parallel alignment by springs 69 attached between pins 72 and pins 70 located on mount 60′.

Figure 12:
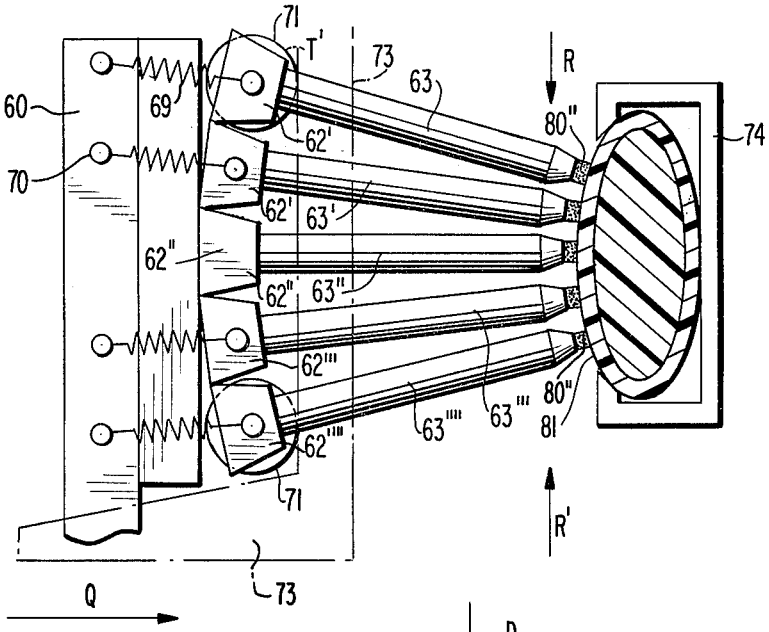
FIG. 12 is a longitudinal view of the picking means of FIG. 10 with picked filament ends melted, and fused to a brush body.

With attention to FIG. 12, after picking filament 80, and fusing the ends 80′ of filament 80 into fused ends 80″ as above described, the picking device 60 is indexed in direction Q into cam closing means 73, whereby cam followers 71 cause picker tube supports 62, 62′, 62‴, and 62⁗ to change attitude thus the distal portions of tubes 63, 63′, 63‴ and 63⁗ converge in direction R–R′ for fusing filament ends 80″ to brush body 81 held in handle holder 74.

Figure 13:
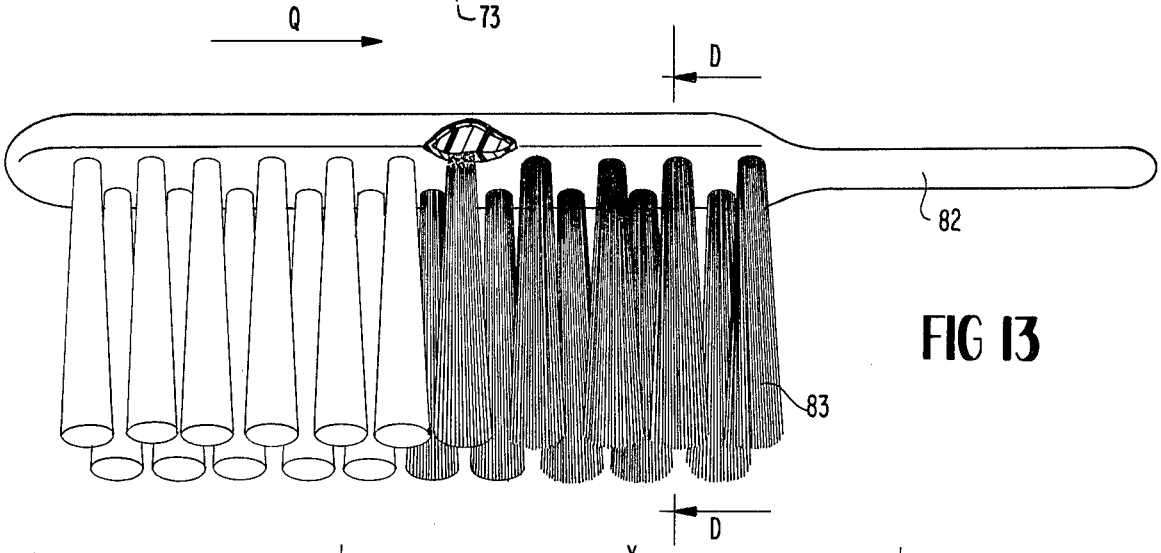
FIG. 13 is a longitudinal view in partial section of a tufted flared counter duster brush made in accordance with this invention.

When picking device 60 is indexed away from brush body 74 in opposite direction of Q, a completely angle-tufted counter duster brush 82 results with angled tufts 83 as shown in FIG. 13.

Figure 14:
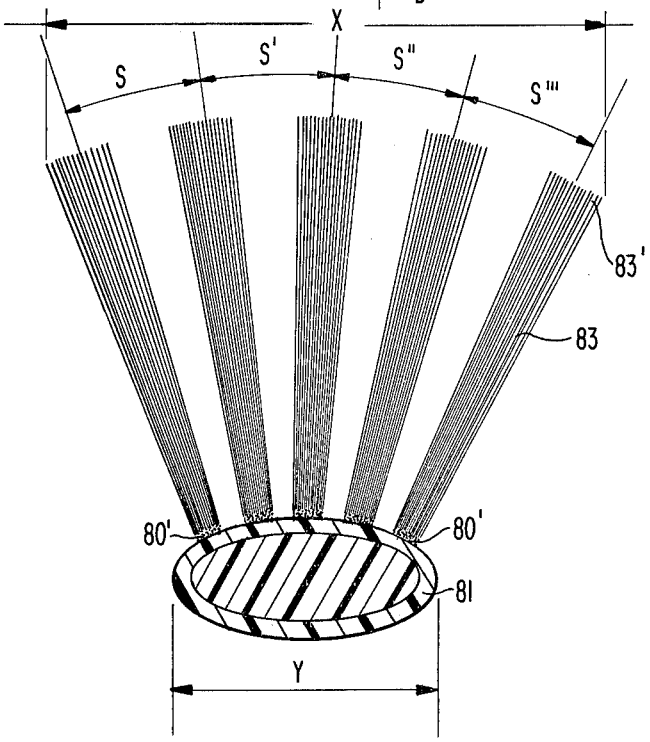
FIG. 14 is a cross-sectional view taken along line D—D of FIG. 13.

FIG. 14 illustrates the flare imparted to the tufts 83. The tufts 83 are angled S, S′, S″ and S‴ and are secured by fused portion 80' to the handle 81. The distance Y across the base of the tufts is significantly different than the distance X across the working end of each tuft 83'.

The angle-tuft-forming pickers of this invention as hereinabove described can be constructed from any conventional metal elements or thermoplastic materials such as polypropylene polyacetal, polyamide and the like. The angle-tuft-forming pickers are not limited to any given size, internal diameter or dimension, or internal cross-sectional configuration. Picking devices of all angular configurations can be fabricated within the scope of this invention.

It has been found that the angle-tuft-forming picker of this invention will pick tufts from assembled parallel cut-to-length synthetic filament having any cross-sectional configuration, such as circular, X-shaped, star-shaped, hollow and the like. The diameter of the filament picked ranges from 0.005 inches to at least 0.250 inches. The length of the cut-to-length can range from about 0.5 up to 30 inches. The composition of the synthetic filament picked and assembled into filament tufts is not limited, and thermoplastic filaments whether oriented or unoriented can be used to form tufts in accordance with this invention. Polymers such as polyamide, polypropylene, polyethylene, copolymers from polyporpylene and ethylene, polyfluoride, and the like may be employed.

This invention may be embodied in other specific forms without departing from the spirit or essential characteristics thereof. The present embodiments are therefore to be considered in all respects as illustrative and not restrictive, the scope of the invention being indicated the appended claims rather than by the foregoing description, and all changes which come within the meaning and range of equivalency of the claims are therefore intended to be embraced therein.

What is claimed and desired to be secured by United States Letters Patent is:

1. In an apparatus for making tufted constructions including a stock box for supporting parallel cut-to-length synthetic filament, means for picking a plurality of said filament to form a plurality of tufts thereof, and means for heat sealing and fusing the non-working ends of said tufts, the improvement comprising:

means for supporting said tufts in a mutually spaced relationship while the ends of said tufts are individually heat sealed and fused, simultaneously;

means for subsequently orienting said tufts so that said tufts converge whereby said oriented tufts may be mounted simultaneously on a synthetic support to form a tufted construction wherein the working ends of said tufts diverge.

2. The apparatus of claim 1, wherein said tufts are supported in a parallel, mutually spaced relationship while said ends are fused.

3. The apparatus of claim 2, wherein said means for orienting said tufts comprises means for orienting said tufts in converging rows of parallel, spaced tufts about a central row of tufts.

4. The apparatus of claim 3 wherein said means for orienting said tufts further comprises cam means and follower means carried by said apparatus for orienting rows of tufts as said follower is displaced relative to said cam in a first direction.

5. The apparatus of claim 4 wherein said means for picking comprises hollow cylindrical pickers; each of said pickers being normally supported in parallel, mutually spaced rows, said apparatus further comprising support means mounting said pickers and follower means.

6. The apparatus of claim 5, wherein said support means comprises a plurality of segmented supports, each segment mounting a row of pickers, hinge means interconnecting adjacent segments for permitting rotation of said segments and the pickers supported thereon into a converging orientation responsive to displacement of said follower relative to said cam in said first direction.

7. The apparatus of claim 6, wherein said support means further comprising bias means connecting each of said segments and said apparatus for normally urging said segments and the pickers supported thereon into a parallel orientation responsive to displacement of said follower relative to said cam in a direction opposite said first direction.

* * * * *